United States Patent [19]

Husa

[11] 4,325,430

[45] Apr. 20, 1982

[54] HEAT RECAPTURE DEVICE

[76] Inventor: Marlin V. Husa, Liberty, Nebr. 68381

[21] Appl. No.: 207,253

[22] Filed: Nov. 17, 1980

[51] Int. Cl.[3] ..... F28D 7/02; F28F 13/00; F24B 7/00

[52] U.S. Cl. ..... 165/135; 126/110 AA; 126/121; 165/155; 165/164; 165/DIG. 2; 237/55

[58] Field of Search ..... 165/DIG. 2, 135, 154, 165/155, 164; 237/55; 126/121, 99 A, 99 D, 99 C, 110 AA, 109, 117, 106

[56] References Cited

U.S. PATENT DOCUMENTS

| | | | |
|---|---|---|---|
| 1,953,302 | 4/1934 | Johnston | 237/55 |
| 2,064,928 | 12/1936 | Lewis | 165/DIG. 2 |
| 2,274,341 | 2/1942 | Mueller | 237/55 |
| 2,730,337 | 1/1956 | Roswell | 165/135 |
| 2,882,023 | 4/1959 | Rizzo | 165/DIG. 2 |
| 2,902,265 | 9/1959 | Dubovick | 165/DIG. 2 |
| 3,188,785 | 6/1965 | Butler | 165/135 |
| 3,913,663 | 10/1975 | Gates | 165/DIG. 2 |
| 4,085,725 | 4/1978 | Mesenbrink | 165/DIG. 2 |
| 4,138,062 | 2/1979 | Graden | 237/55 |
| 4,276,926 | 7/1981 | Evangelow | 165/155 |

*Primary Examiner*—Daniel J. O'Connor
*Attorney, Agent, or Firm*—William D. West

[57] ABSTRACT

A heat recapture device for attachment to a furnace or fireplace exhaust flue is disclosed. Duct work in the device allows ambient air to be warmed by combustion exhaust gases. Air thus heated may be used to heat the surrounding living space. Additional duct work causes circulation of fresh air into the room and serves as a heat insulating shield around the periphery of the device.

7 Claims, 5 Drawing Figures

HEAT RECAPTURE DEVICE

BACKGROUND OF THE INVENTION

In recent years, heating costs have increased rapidly due to the increased costs of fuel oil and natural gas. As a result of rising energy costs, a great number of home owners, especially in the northern states, have begun to utilize various cost efficient means, such as home insulation and wood burning stoves and fireplaces to reduce their winter heating bills.

Another method of reducing energy costs is to make existing furnaces and fireplaces heat more efficiently. During the normal operation of any furnace or fireplace, hot combustion gases are vented into the atmosphere through the furnace flue or chimney. A furnace or fireplace could be made to operate more efficiently if some of the heat from the combustion gases could be recaptured and used to heat the air inside the home.

The present invention is a device for recapturing some of the heat from combustion exhaust gases which may be installed at any convenient location in a chimney or furnace flue.

A number of devices have been patented which, in some way, deal with the recapture of heat from a furnace exhaust flue.

Anable, U.S. Pat. No. 3,930,489 discloses a system for preheating the conditioning air in a forced air furnace. Before entering the furnace heat exchanger, the conditioning air is forced to move in the close proximity of the furnace exhaust stacks. This is accomplished by elongating the exhaust stack between the furnace and the chimney, enclosing the exhaust stock within a hood, adding baffles to promote circulation around the exhaust stacks, and drawing the air through this system by a conventional air forcing means.

Hergenrother, U.S. Pat. No. 2,619,022 discloses a device for preheating air that is to be heated by a furnace located in the basement. The chimney of the device consists of a metallic exhaust stack which is enclosed in a larger pipe. The enclosing pipe has openings for drawing air from the various rooms and from the atmosphere. The lower end of the enclosing pipe is connected by an air duct to the furnace. As air is drawn from the rooms through the enclosing pipe, and into the furnace, it is heated by the exhaust stack.

Smith, U.S. Pat. No. 4,009,705 describes a venting system for a gas fired heater which will eliminate back drafts from the chimney and provides a monitoring device that will shut off the heating system in case of a blocked flue. Increased heating efficiency results from preheating the furnace intake air with heat from the exhaust flue.

Funk, U.S. Pat. No. 3,124,197 discloses a forced air heat exchanging device that is connected to a combustion exhaust flue. The device contains a circular pipe, through which the heated exhaust gases pass, which is surrounded at its exterior surface by a series of air veins. Conditioning air is forced through the air veins, absorbing heat from the walls of the pipe. The air is then directed into a room or other area to be heated.

Konnerth III, U.S. Pat. No. 4,050,628 is another forced air heat exchanger device that is connected at a break in an exhaust stack or flue.

Mayer U.S. Pat. No. 4,050,627 discloses a heat exchanger which extracts heat from an exhaust flue. The heat exchanger is connected at a break in the exhaust stack. A number of small air conduits are located within a heating chamber through which the flue gases are passed. Air which is forced through the air conduit is used for heating the surrounding area. A baffle mechanism within the heating chamber allows the surface area of the air conduit which is exposed to the flue gases to be varied. The amount of heat extracted from the flue gases can thereby be controlled.

Thulman, U.S. Pat. No. 2,634,720 describes means for lowering the surface temperature of a chimney and for producing desirable flue temperature gradients by circulating air in a parallel duct arrangement around the flue. The circulating air is drawn into the duct arrangement through an inlet in the roof or attic and is discharged into the atmosphere near the top of the chimney.

Waterbury, U.S. Pat. No. 1,146,980 describes an apparatus that encloses a section of an exhaust flue and wood or coal burning stove in an exterior housing that is vented to the atmosphere. Air from the room passes into an orifice at the lower end of the housing, absorbs radient heat from the stove and flue, and then passes into the atmosphere creating a circulation and ventilation of air in the room.

Husa, U.S. patent application Ser. No. 146,007 filed May 2, 1980 describes a heat recapture device to be used in connection with a fireplace firebox.

Although the above inventions deal with the extraction of heat from flue gases, none of them disclose a device for installation in a flue which may be produced inexpensively and which can furnish heated forced air and, in addition, induce fresh air circulation into a room.

SUMMARY OF THE INVENTION

The present invention consists essentially of three air conduits spaced inside one another creating two enclosed air passageways, as well as a central air passageway through which combustion gases may pass. A fourth conduit is oriented at a diagonal position within the conduit through which the combustion gases flow and is in fluid communication with the more inwardly spaced air passageway. An induction fan located at the base of the apparatus forces fresh air into the inwardly spaced air passageway located between the combustion conduit and the next more radially removed conduit. As the fresh air is forced through this internal passageway, it absorbs heat from the walls of the combustion conduit. Thereafter, it is forced through the diagonal conduit where it is further heated by the combustion gases before being discharged into the room directly or into the home's conditioning air system. The air in the most radially removed air passageway communicates either with the conditioning air in the adjacent air passageway or with the ambient air. The most radially removed air passageway is also vented into the exhaust stack, which, because of the high velocity of the exhaust gases, creates a suction which draws air through the exterior air passageway. The air flow thus produced has the effect of increasing fresh air circulation into the room as well as cooling the exterior surface of the heat recapture device, reducing the chance of burns for anyone coming into contact with the surface of the apparatus. Because the circulation air flow is induced by the velocity of the exhaust gases, circulation will continue, whether or not the induction fan is in operation.

A thermostat device automatically turns the induction fan on or off as necessary to bring the air in the room to the desired temperature.

Accordingly, it is the primary object of the present invention to furnish a heat recapture device which uses the heat from combustion exhaust gases to heat the air in a room.

It is a further object of the invention to furnish a heat recapture device which may be installed in a furnace flue or fireplace chimney.

It is a further object of the invention to furnish a heat recapture device which increases the circulation of air in a room.

It is a further object of the invention to furnish a heat recapture device which is convenient to install in an attic, basement or other unheated portion of a house.

It is a further object of the invention to furnish a heat recapture device which is energy efficient and inexpensive to install and operate.

It is a further object of the invention to furnish a heat recapture device which may serve as a secondary heat source to an existing conditioning air conduit.

It is a further object of the invention to furnish a heat recapture device with a circulating air flow to eliminate flue gases from a room while cooling the external surface of the apparatus.

It is a further object of the invention to furnish a heat recapture device which has a recirculating air flow which is not dependent on the operation of a fan.

It is a further object of the invention to furnish a heat recapture device which is safe and easy to operate.

DESCRIPTION OF THE PREFERRED EMBODIMENT

Figure 1:
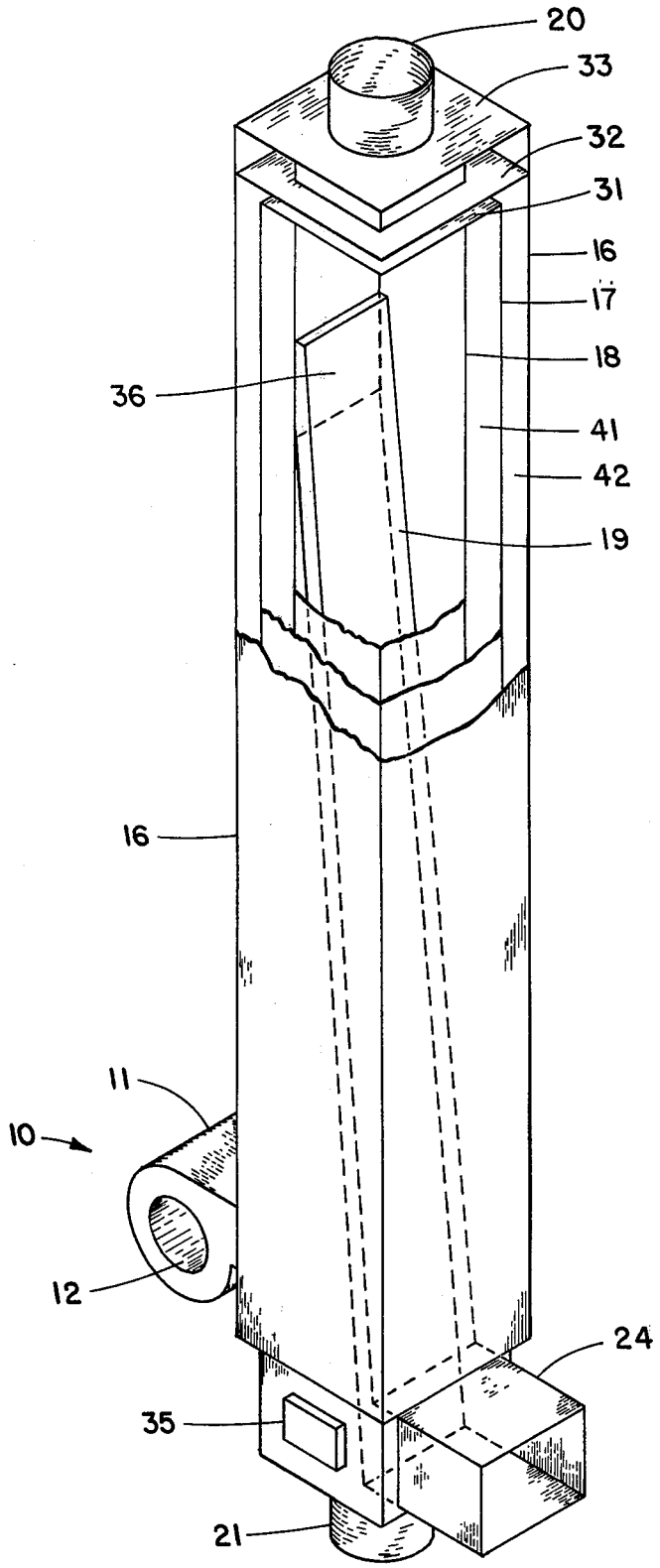
FIG. 1 is a cut-away perspective view of the heat recapture device.

It may be seen from FIG. 1 that the heat recapture device may be connected at some intermediate point in an exhaust stack (not shown) by means of a lower exhaust stack connector 21, and an upper exhaust stack connector 20. In this particular embodiment, the exhaust stack connectors 20, 21, are circular metallic conduit of the type used in furnace flues or wood heating stoves. The connectors are attached to the appropriate flue sections to form an air-tight seal by conventional means well known in the heating and ventilating arts.

Figure 2:
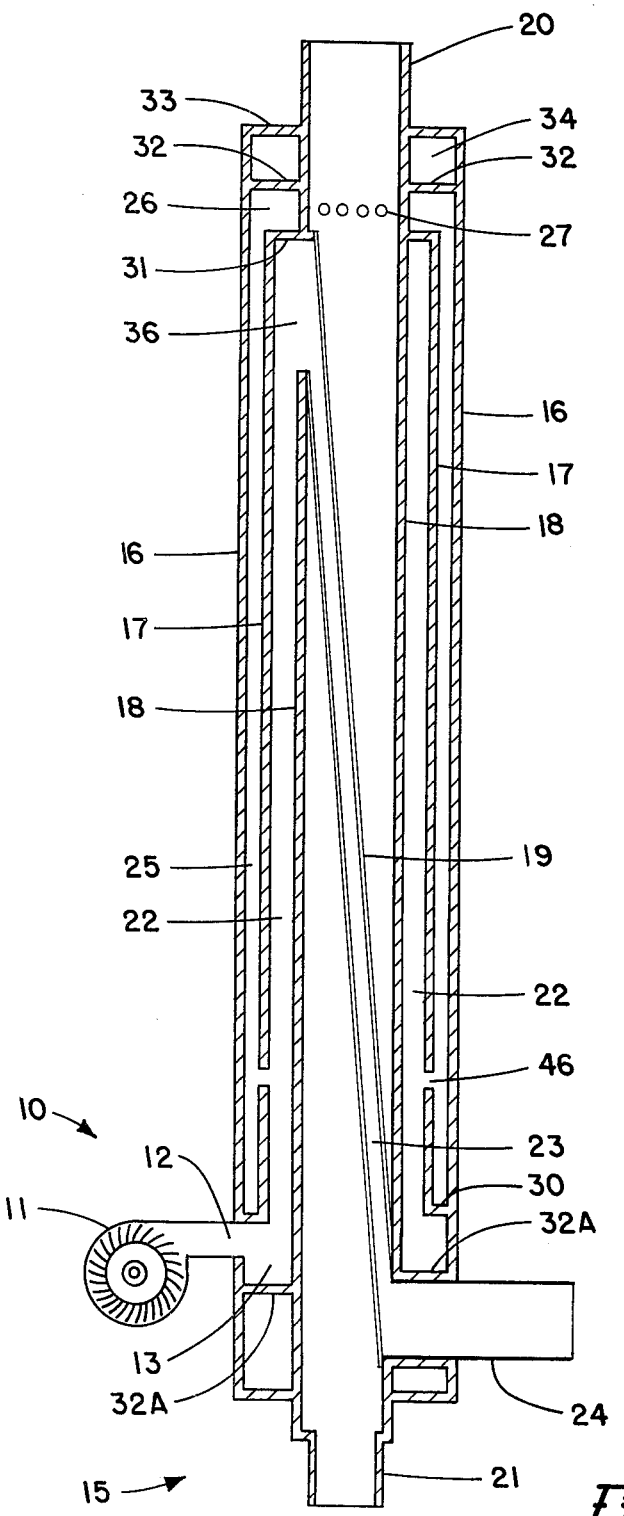
FIG. 2 is a cross-sectional elevation view of the heat recapture device.

It may be seen from FIGS. 1 and 2 that the exhaust stack connectors 20 and 21 are in turn rigidly attached to an inner conduit 18 which, in the preferred embodiment depicted in the drawing, has a rectangular shape and is of a sheet metal construction. The connectors 20, 21 are attached to the inner conduit to form an air-tight seal by conventional means well known in the art.

A transverse air duct 19 passes diagonally through the interior of the inner conduit 18 as shown in FIG. 2.

Figure 3:
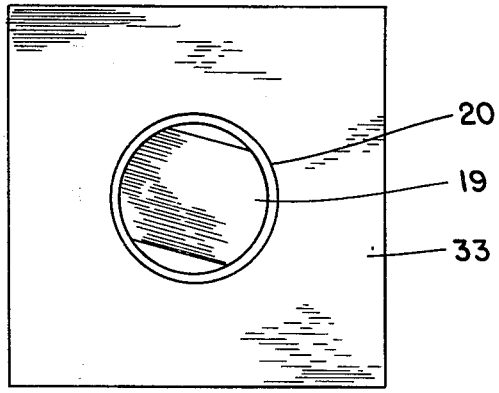
FIG. 3 is a top view of the heat recapture device.
Figure 4:
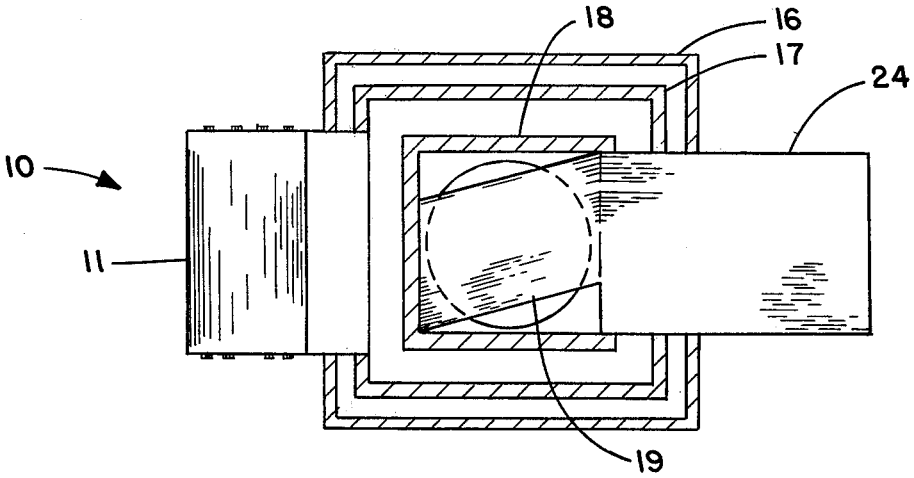
FIG. 4 is a cut-away top view of the heat recapture device showing the placement of the various conduits.
Figure 5:
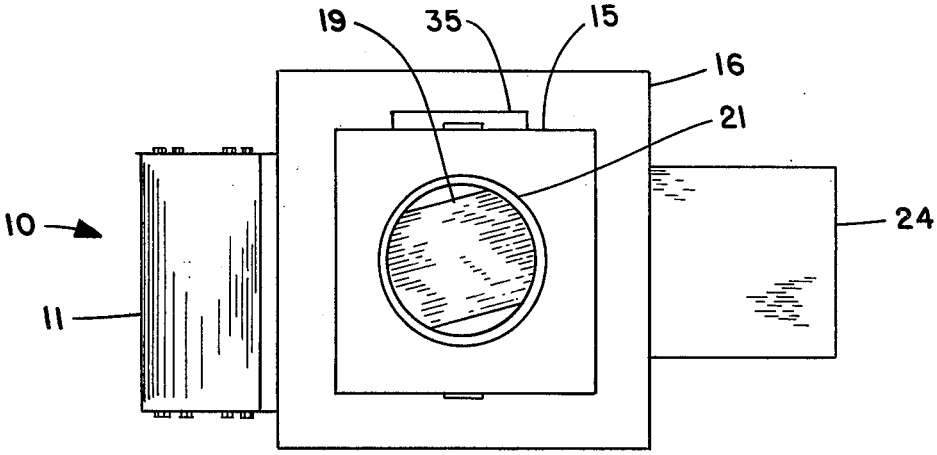
FIG.5 is a bottom view of the heat recapture device.

As shown in FIGS. 3, 4 and 5, the upper end of the transverse air duct 19 is attached to a corner section of the inner conduit 18 and the lower end of the transverse air duct 19 is attached to the opposite corner of the inner conduit 18 by welding or other conventional means well known in the art to produce an air-tight seal at the intersecting surfaces. The intersected portion of the inner conduit 18 is then cut away to create an opening 36, 37, at either end of the transverse air duct as shown in FIG. 2.

A middle conduit 17 is positioned about the exterior of the inner conduit 18 as shown in FIG. 2. In the preferred embodiment, the middle conduit 17 is also of a rectangular construction and extends out a distance of three to six inches from the inner conduit 18 on all sides. The middle conduit 17 is connected to the inner conduit 18 by means of a baffle plate 31. The baffle plate 31 has a rectangular shape conforming to a cross section of the middle conduit 17 with a cut out conforming to the cross section of the inner conduit 18, thus allowing the baffle plate 31 to be welded or otherwise attached to the inner conduit 18 and middle conduit 17 to form an air-tight seal.

An outer conduit 16, as shown in FIGS. 1 and 2, is positioned about the outside of the middle conduit 17 and inner conduit 18. The upper and lower portion of the outer conduit 16 extend beyond the ends of the middle conduit 17, and are attached to the inner conduit 18 by means of baffle plates 32 and 32A in the same manner as the middle conduit baffle plate 31 described above. The outer conduit 16 wall is uniformly spaced from the middle conduit 17 wall at a distance of less than an inch. An air-tight sealing strip 30 is located in the gap between the outer conduit 16 and middle conduit 17 and is attached by welding or other conventional means.

It may be seen from the above that a conditioning air passage 41 has been formed by the walls of inner conduit 18, middle conduit 17 and the middle conduit baffle plate 32. The conditioning air gap 41 thus formed is in fluid communication with the upper transverse air duct opening 36. It can also be seen that a circulation air passage 42 has formed by the walls of middle conduit 17 and outer conduit 16 and the upper and lower baffle plates 32, 32A. The circulation air passage 42 is in fluid communication with the conditioning air passage 41 through opening 46 in the middle conduit 17 wall.

A series of spaced holes 27 bored through the inner conduit 18 at a position midway between the two upper baffle plates 31, 32, allows the air in the circulation air gap 42 to communicate with the interior area of the inner conduit 18. A cap 33 welded or otherwise permanently attached to the top of the upper baffle plate 32 and the inner conduit 18 creates an additional insulating air gap 34 and provides additional structural strength to the apparatus near the point of connection to the chimney flue.

As shown in FIGS. 1 and 2, an induction fan 10 is attached to the outer conduit 16 near its lower end. The induction fan discharge orifice 12 is positioned at an opening in the wall of the outer conduit 16. The middle conduit terminates at a position just above the induction fan discharge opening 12. The area below the termination point of the middle conduit 17 bounded by the outer conduit wall 16, the lower baffle plate 32A and the inner conduit wall 18 create a plenum chamber 13. The plenum chamber 13 is in fluid communication with the conditioning air passageway 41 through the gap 45 at the lower end of the middle conduit 17.

An air dispensing conduit 24 intersects and passes through the inner conduit 18 and insulating shield 46 to intercept the lower opening 37 of the transferse air duct 19 and is welded or otherwise attached by means well known in the art to the inner conduit 18 and air duct 19 along the planes of intersection.

It may be seen from the above that air from the room enters the system at the induction fan intake orifice 11 and is propelled through the induction fan discharge opening 12 into the intake air plenum chamber 13. The air then passes into the circulation air passage 42 through the air gap 45.

After entering the conditioning air gap the main air flow passes in fluid contact with the walls of the inner conduit 18 thereby absorbing heat from the exhaust gases which radiate through the walls of the inner conduit 18. The pressure differential created by the induction fan 10 then forces the conditioning air through the upper opening 36 of the transverse air duct 19 and down through the transverse air duct 19 where additional heat energy from the exhaust gases is absorbed. The conditioning air is then discharged through the transverse air duct lower opening 37 into the room or into a conditioning air distribution conduit 24 as shown in FIGS. 1, 2 and 5.

Air passing from the conditioning air passage 41 into the circulation air passage 42 passes upwards through the air passage and is discharged into the inner conduit 18 through the holes 27 bored therein. The pressure differential created by the high velocity of the exhaust gases within the inner conduit 18 ensures that the air moving through the circulation air passage 42 will continue to flow even when the induction fan 10 is not in operation.

The thermostat 35 as shown in FIG. 1 turns the fan on and off to maintain a preselected temperature in the room by conventional means well known in the art.

Obviously, many modifications and variations of the described invention are possible. It is, therefore, understood within the scope of the inventor's claim that the invention may be practiced otherwise than as specifically described.

I claim:

1. A device for recapturing heat from a combustion exhaust stack comprising:

(a) a first conduit open at either end to allow the passage of combustion exhaust gases;

(b) connection means for sealingly connecting said first conduit to the combustion exhaust stack;

(c) a second conduit concentrically positioned around said first conduit, in uniform spaced relation thereto, and sealingly attached to the periphery of said first conduit by second conduit baffle plates positioned at either end of said second conduit, to form a conditioning air chamber;

(d) at least one transverse air duct intersecting and passing transversely through said first conduit and sealingly attached to the walls of said first conduit wherein said transverse air duct has a first end and a second end and wherein said first end is in fluid communication with said conditioning air chamber, and wherein said second end is in fluid communication with a conditioning air dispensing means;

(e) at least one conditioning air intake port in fluid communication with said conditioning air chamber and the ambient air;

(f) air forcing means for producing a conditioning airflow through said intake port, said conditioning air chamber, said transverse air duct and said conditioning air dispensing means said device further comprising a third conduit concentrically positioned around said second conduit in uniform spaced relation thereto, wherein said third conduit extends axially in either direction beyond the ends of said second conduit and wherein the ends of said third conduit are sealingly connected by third conduit baffle plates to the periphery of said first conduit to form an insulating air chamber; and wherein said insulating air chamber is in fluid communication with the ambient air through an insulating air intake means positioned near the lower end of said insulating air chamber and wherein said insulating air chamber is in fluid communication with the combustion exhaust gases through an insulating air exhaust means positioned near the upper end of said insulating air chamber.

2. The device for recapturing heat of claim 1 wherein said insulating air intake means is an opening in said second conduit proximate said conditioning air chamber ambient air intake port.

3. The device for recapturing heat of claim 1 wherein said insulating air intake means is an opening in said third conduit.

4. The device for recapturing heat of either claim 2 or 3 wherein said insulating air chamber exhaust means is at least one opening in said first conduit positioned between said second conduit upper baffle plate and said third conduit upper baffle plate.

5. The device for recapturing heat of claim 4 wherein said air forcing means is a fan positioned at the conditioning air intake port.

6. The device for recapturing heat of claim 5 wherein the first end of said transverse air duct is positioned in the upper portion of said first conduit and wherein the second end of said transverse air duct is positioned in the lower section of said first conduit.

7. The device for recapturing heat of claim 6 wherein said first conduit, said second conduit, said third conduit and said transverse air duct are each a straight metal conduit with a rectangular cross section.

* * * * *